US005407765A

United States Patent [19]

Collins et al.

[11] Patent Number: 5,407,765

[45] Date of Patent: Apr. 18, 1995

[54] METHOD OF SPRAY-DEPOSITING AN ORGANIC CONDUCTOR TO MAKE A SCREEN ASSEMBLY FOR A CRT

[75] Inventors: Brian T. Collins, Lancaster; Harry R. Stork, Adamstown; Peter M. Ritt, East Petersburg, all of Pa.

[73] Assignee: Thomson Consumer Electronics, Inc., Indianapolis, Ind.

[21] Appl. No.: 168,488

[22] Filed: Dec. 22, 1993

[51] Int. Cl.[6] ..... G03C 5/00

[52] U.S. Cl. ..... 430/28; 430/23; 430/29

[58] Field of Search ..... 430/28, 23, 29

[56] References Cited

U.S. PATENT DOCUMENTS

| | | | |
|---|---|---|---|
| 3,475,169 | 10/1969 | Lange | 96/1 |
| 3,489,556 | 1/1970 | Drozd | 96/1 |
| 4,245,020 | 1/1981 | van den Berg | 430/24 |
| 4,282,118 | 8/1981 | Hwang | 430/270 |
| 4,921,767 | 5/1990 | Datta et al. | 430/23 |
| 4,990,416 | 2/1991 | Mooney | 430/26 |

FOREIGN PATENT DOCUMENTS 49-39315 9/1969 Japan .

*Primary Examiner*—S. Rosasco

*Attorney, Agent, or Firm*—Joseph S. Tripoli; Dennis H. Irlbeck; Vincent J. Coughlin

[57] ABSTRACT

The method of electrophotographically manufacturing a screen assembly on an interior surface of a viewing faceplate of a panel for a color CRT, according to the present invention, includes the steps of forming a volatilisable organic conductive layer on the interior surface of the viewing faceplate and overcoating the organic conductive layer with an organic photoconductive solution to form a volatilizable organic photoconductive layer. The conductive solution, comprising a polyelectrolyte and a diluent, is applied to the interior surface of the viewing faceplate by spraying, to form the conductive layer.

10 Claims, 3 Drawing Sheets

METHOD OF SPRAY-DEPOSITING AN ORGANIC CONDUCTOR TO MAKE A SCREEN ASSEMBLY FOR A CRT

The invention relates to a method of manufacturing a luminescent screen assembly for a cathode-ray tube (CRT) by the electrophotographic screening (EPS) process and, more particularly, to a method in which an organic conductive layer is spray-coated onto an interior surface of a viewing faceplate.

BACKGROUND OF THE INVENTION

U.S. Pat. No. 4,921,767, issued to Datta et al., on May 1, 1990, describes a method for electrophotographically manufacturing a luminescent screen assembly on an interior surface of a CRT faceplate using dry-powdered, triboelectrically charged, screen structure materials deposited on a suitably prepared, electrostatically chargeable surface. The chargeable surface, or photoreceptor, comprises an organic photoconductive (OPC) layer overlying, preferably, an organic conductive (OC) layer, both of which are deposited, serially, as solutions on the interior surface of the CRT panel. The solutions are "spin coated", i.e., a quantity of each solution is deposited onto the interior surface of the faceplate, and the panel is rotated to uniformly disperse the solution and create a layer of substantially uniform thickness. The OC layer, formed from an aqueous solution, must be thoroughly dry before the OPC layer can be formed thereon. To dry the OC layer, heated air or quartz heaters are directed against the deposited solution; however, the drying time for an aqueous solution is two or three minutes. Such a long drying time introduces inefficiencies into the manufacturing process.

A need therefore exists for a suitable fast drying, inexpensive, easily applied conductive solution that is compatible with the overlying OPC layer, and which overcomes the above-mentioned shortcoming of the known aqueous conductive solutions.

SUMMARY OF THE INVENTION

To this end, a method of manufacturing a luminescent screen assembly for a color CRT on an interior surface of a viewing faceplate of a panel comprises the steps of: coating the interior surface of the viewing faceplate to form a volatilizable organic conductive layer; and overcoating the organic conductive layer with an organic photoconductive solution to form a volatilizable organic photoconductive layer. The present method is an improvement over prior methods because the step of coating the interior surface of the viewing faceplate to form a volatilizable organic conductive layer includes the substeps of: providing an organic conductive solution comprising a polyelectrolyte selected from the group consisting of poly(dimethyl-diallyl-ammonium chloride), and a copolymer of vinylimidazolium methosulfate and vinylpyrrolidone; and a diluent selected from the group consisting of ethyl alcohol, methyl alcohol, and water; and, spraying the organic conductive solution onto the interior surface of the faceplate to form the volatilizable organic conductive layer, which is substantially continuous and provides an electrode for the overlying organic photoconductive layer.

CROSS REFERENCE TO RELATED APPLICATIONS

This invention can be used with the invention described in the copending patent application entitled, "Organic Photoconductor For An Electrophotographic Screening Process For A CRT", by P. Datta et al., filed concurrently herewith.

BRIEF DESCRIPTION OF THE DRAWINGS

The invention will now be described in greater detail, with relation to the accompanying drawings, in which.

DETAILED DESCRIPTION OF THE PREFERRED EMBODIMENT

Figure 1:
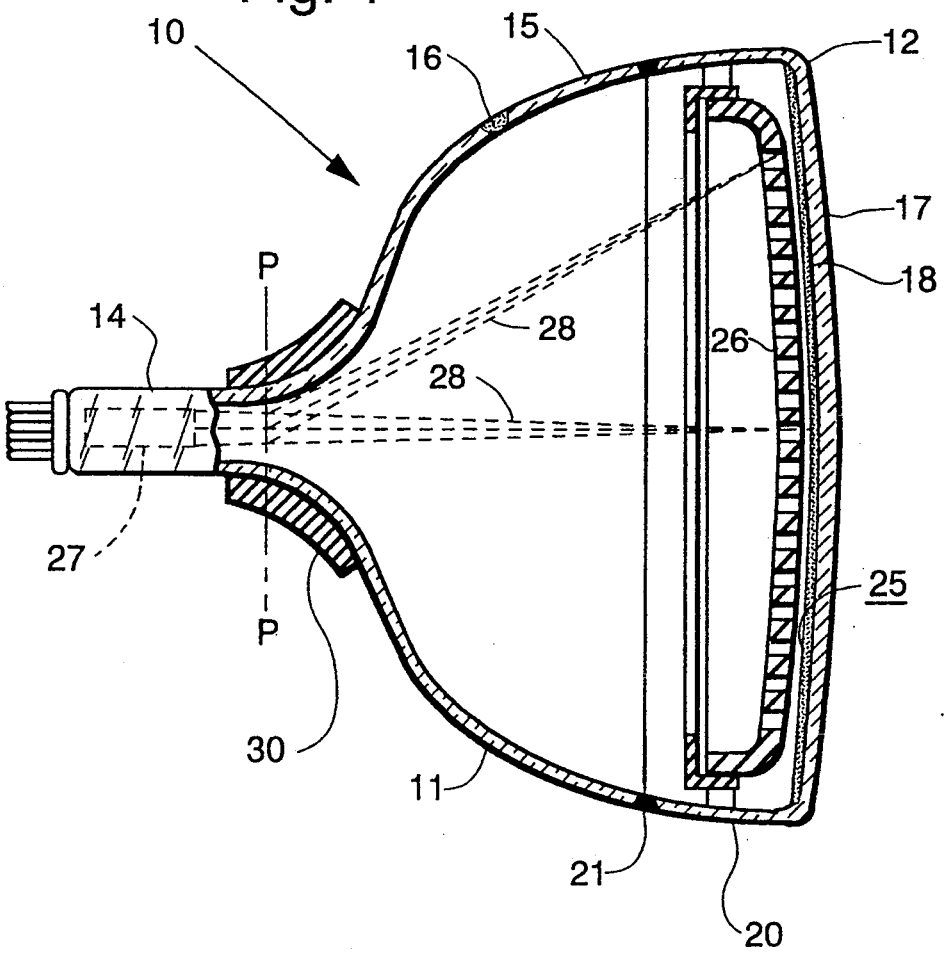
FIG. 1 is a plan view, partially in axial section, of a color CRT made according to the present invention.
Figure 2:
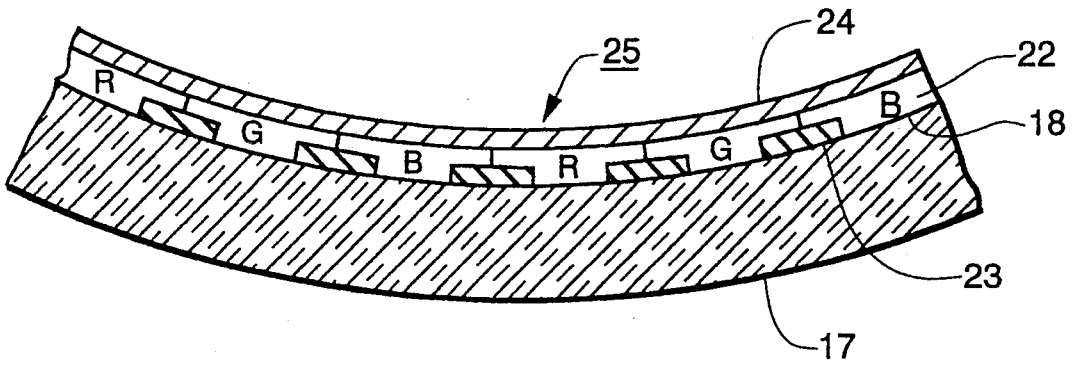
FIG. 2 is a section view of a screen assembly of the tube shown in FIG. 1.

FIG. 1 shows a color display device, such as a CRT, 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate 17 having an interior surface 18 and a peripheral flange or sidewall 20, which is sealed to the funnel 15 by a glass frit 21. A three color luminescent screen 22 is carried on the interior surface 18 of the viewing faceplate 17. The screen 22, shown in FIG. 2, preferably is a line screen which includes a multiplicity of screen elements comprised of red-emitting, green-emitting and blue-emitting phosphor stripes, R, G and B, respectively, arranged in color groups or picture elements of three stripes, or triads, in a cyclic order and extending in a direction which is generally normal to the plane in which impinging electron beams are generated. In the normal viewing position for this embodiment, the phosphor stripes extend in the vertical direction. Preferably, the phosphor stripes are separated from each other by a light-absorbive matrix material 23, as is known in the art. Alternatively, the screen can be a dot screen. A thin conductive layer 24, preferably of aluminum, overlies the screen 22 and provides a means for applying a uniform potential to the screen as well as for reflecting light, emitted from the phosphor elements, through the faceplate 17. The screen 22 and the overlying aluminum layer 24 comprise a screen assembly 25.

Again with respect to FIG. 1, a multi-apertured color selection electrode, or shadow mask, 26 is removably mounted, by conventional means, in predetermined spaced relation to the screen assembly 25. An electron gun 27, shown schematically by the dashed lines in FIG. 1, is centrally mounted within the neck 14, to generate and direct three electron beams 28 along convergent paths through the apertures in the mask 26 to the screen 22. The gun 27 may, for example, comprise a bi-potential electron gun or any other suitable gun.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1, at about the middle of the yoke 30. For simplicity, the actual curvature of the deflection beam paths in the deflection zone is not shown.

Figure 4:
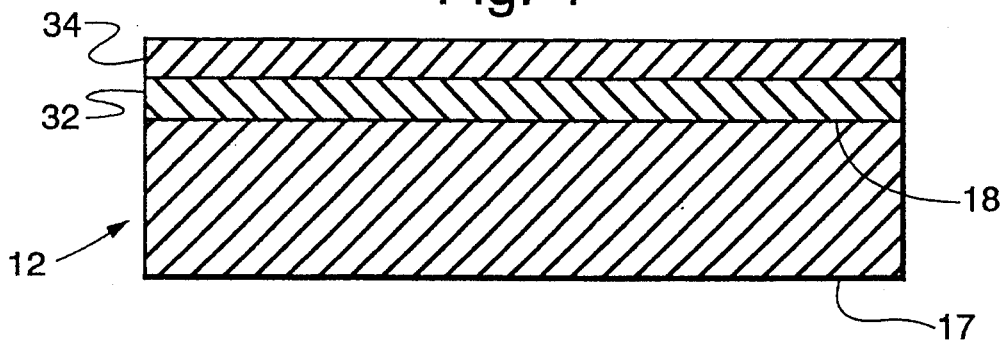
FIG. 4 is a section of a faceplate panel showing a photoconductive layer overlying the present conductive layer.
Figure 3:
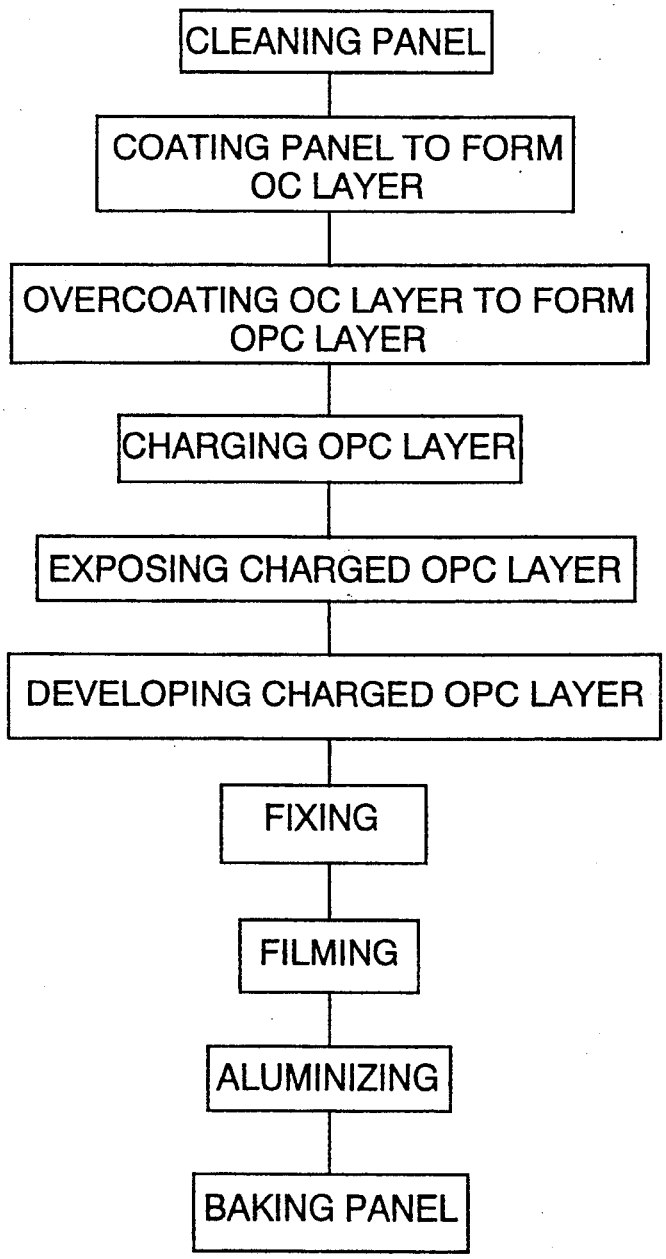
FIG. 3 is a block diagram of the processing sequence utilized in the EPS process.

The screen 22 is manufactured by the electrophotographic screening (EPS) process that is described in U.S. Pat. No. 4,921,767, cited above, and shown in block diagram in FIG. 3. Initially, the panel 12 is washed with a caustic solution, rinsed in water, etched with buffered hydrofluoric acid and rinsed again with water, as is known in the art. The interior surface 18 of the viewing faceplate 17 is then provided with a photoreceptor comprising a suitable layer 32 of a volatilizable organic conductive (OC) material which provides an electrode for an overlying volatilizable organic photoconductive (OPC) layer 34. The OC layer 32 and the OPC layer 34 are shown in FIG. 4.

In order to form the matrix 23 by the EPS process, the OPC layer 34 is charged to a suitable potential within the range of +200 to +700 volts using a corona charger. The shadow mask 26 is inserted into the panel 12 and the positively charged OPC layer 34 is exposed, through the shadow mask 26, to actinic radiation, such as light from a xenon flash lamp disposed within a conventional three-in-one lighthouse (not shown). After each exposure, the lamp is moved to a different position to duplicate the incident angle of the electron beams from the electron gun. Three exposures are required, from the three different lamp positions, to discharge the areas of the OPC layer 34 where the light-emitting phosphors subsequently will be deposited to form the screen 22. After the exposure step, the shadow mask 26 is removed from the panel 12, and the panel is moved to a first developer (not shown). The developer contains suitably prepared dry-powdered particles of a light-absorptive black matrix screen structure material. The matrix material is triboelectrically-negatively charged by the developer. The negatively charged matrix material may be directly deposited in a single step, or it may be directly deposited in two steps. The "two step" matrix deposition process increases the opacity of the resultant matrix 23. The light emitting phosphor materials are then deposited onto the OPC layer 34 in the manner described in U.S. Pat. No. 4,921,767.

It is also possible to form the matrix using a conventional wet matrix process of the type known in the art. If the matrix is formed by the wet process, then the photoreceptor is formed on the matrix and the phosphor materials are then deposited in the manner described in U.S. Pat. No. 4,921,767.

Figure 5:
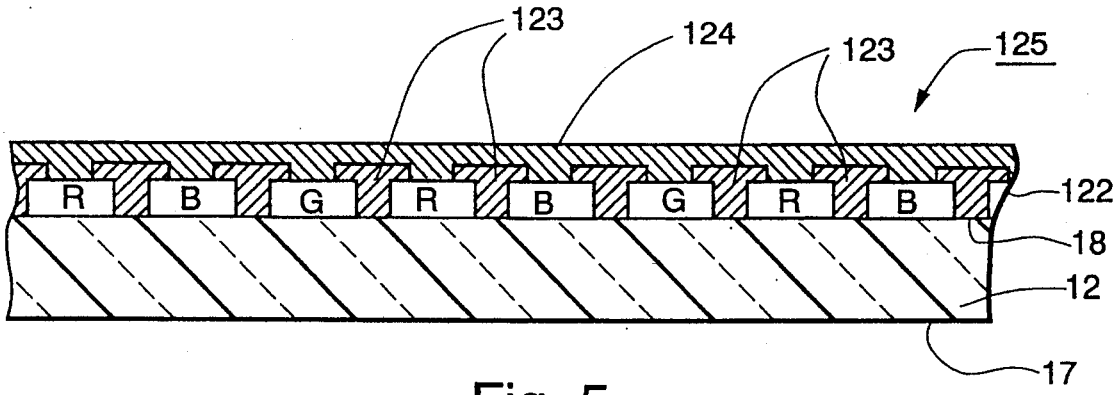
FIG. 5 is an alternative embodiment of a screen assembly of the tube shown in FIG. 1.

As an alternative to both of the above-described "matrix first" processes, a matrix 123 can be electrophotographically formed after the phosphors are deposited by the EPS process. FIG. 5 shows a screen assembly 125 comprising a screen 122, matrix elements 123 and an overlying aluminum layer 124 made according to a "matrix last" process.

In the "matrix last" process, the red-, blue-, and green-emitting phosphor elements, R, B and G, respectively, are formed by serially depositing triboelectrically-positively charged particles of phosphor screen structure material onto a positively charged OPC layer 34 of the photoreceptor. The charging process is the same as that described above. After the three phosphors are deposited, the OPC layer 34 is, once again, uniformly charged to a positive potential and the panel 12, containing the phosphor materials is disposed on a matrix developer (not shown), which provides a triboelectrically-negative charge to the matrix screen structure material. The positively charged open areas of the OPC layer 34, separating the phosphor screen elements, are directly developed by depositing onto the open areas the negatively charged matrix materials to form the matrix 123. This process is called "direct" development. The screen structure materials are then fixed and filmed as described in U.S. Pat. No. 4,921,767. The aluminum layer 124 is provided on the screen 122 for the purpose described above for the deposition of the layer 24.

The faceplate panel 12 with the aluminized screen assembly 25 or 125 is then baked at about 425° C. for about 20–30 minutes, to volatilize the constituents of the screen assembly. It should be appreciated that the screen making process described above, can be modified by reversing both the polarity of the charge provided on the OPC layer 34 and the polarity of the triboelectric charge induced on the screen structure materials, to achieve a screen assembly identical in structure to those described above.

Figure 6:
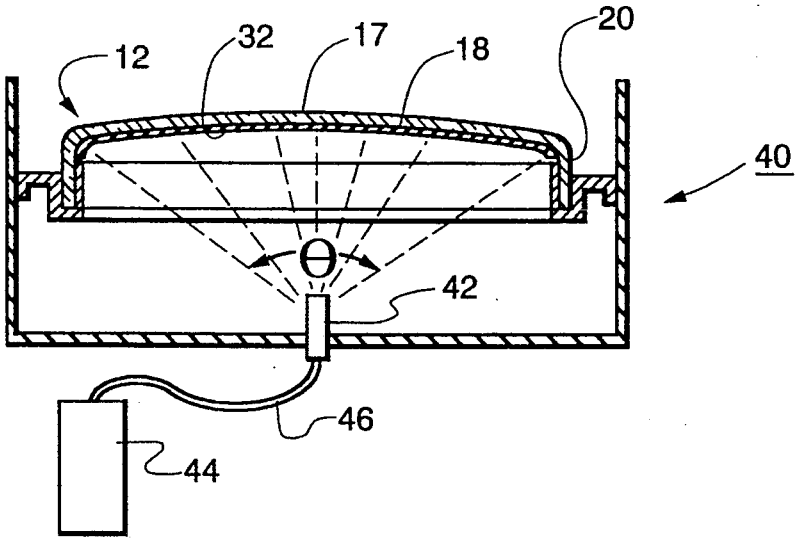
FIG. 6 is a schematic view of a faceplate panel mounted in a spray apparatus, during a step in the manufacturing process.

With reference to FIGS. 4 and 6, the OC layer 32 is formed by spraying a volatilizable organic conductive solution onto the interior surface 18 of the faceplate 17. The solution differs from known previous conductive solutions in that it consists essentially of a polyelectrolyte selected from the group consisting of poly(dimethyl-diallyl-ammonium chloride), and a copolymer of vinylimidazolium methosulfate (VIM) and vinlypyrrolidone (VP); polyvinyl pyrrolidone (PVP); and a diluent selected from the group consisting of ethyl alcohol, methyl alcohol, and water.

Poly(dimethyl-diallyl-ammonium chloride) is available commercially from the Calgon Corp, Pittsburgh, Pa. as Cat-Floc-CL or CAT Floc-T-2, and the copolymer of VIM and VP is available as Luviquat MS-905, from BASF Corp., Parsippany, N.J. The commercially available Cat-Floc materials contain the polyelectrolyte as well as inorganic salts, such as NaCl and $K_2SO_4$, dissolved in water, which, when made into the OC layer, do not bake out completely after panel bake. The chloride ion of the inorganic salt must be removed, or at least reduced in concentration, from the purchased Cat-Floc material before it can be used to make an organic conductor, because the chloride ion is detrimental to tube life.

To remove or reduce the chloride ion bound to the organic polymer chain of the Cat-Floc material, a ten percent (10%) solution of Cat-Floc is dissolved in triple distilled water and mixed with ten percent (10%) solid anion exchange beads for two hours. The mixture is then filtered through a 5$\mu$ pressure filter and the Cat-Floc from the ion exchange is precipitated from the solution with acetone. The precipitate is then washed with acetone and water in a ratio of 80:20, and dissolved in water to make an aqueous solution containing 50 wt. % of Cat-Floc. The pH of the chloride-reduced Cat-Floc is within the range of 12–13. The pH is adjusted to a pH of 4 by titration with 0.1% $HNO_3$ or 0.1% $H_3PO_4$.

The following examples are meant to illustrate the OC layer 32 in greater detail, but not to limit it in any way.

OC EXAMPLE 1

An organic conductive solution is formed by mixing the following ingredients thoroughly for one hour and filtering the solution through a 1 micron ($\mu$) filter.

140 g (0.67 wt % of solids) of a 50% solution, in water, of Cat-Floc-Cl;

350 g (0.33 wt. % of solids) of a 10% solution of PVP, in methyl alcohol; and 10,010 g of methyl alcohol In the above example, ethyl alcohol may be substituted for methyl alcohol, either in whole or in part; however, ethyl alcohol has a higher boiling point than methyl alcohol and thus, a solution containing ethyl alcohol as the diluent would take longer to dry than one containing only methyl alcohol as the diluent. The quantity of water in the solution of above example is only 0.67 wt. % and is present in the form of the Cat-Floc solution; however, more water may be added as a diluent, but the drying time of the solution would be longer than that: of a solution containing only methyl alcohol as the diluent.

OC EXAMPLE 2

A second organic conductive solution is formed by mixing and filtering the following ingredients in the manner described in OC Example 1.

75–100 g (3 wt. % of solid) MS-905, a copolymer of vinylimidazolium methosulfate (VIM) and vinlypyrrolidone (VP); and 925–900 g (balance) methyl alcohol.

As shown in FIG. 6, the OC solution is sprayed, under pressure, onto the interior surface 18 of the faceplate 17 and along an interior portion of the sidewall 20 of the panel 12, using a spray apparatus 40 having a moveable nozzle (42) which produces a flat spray that is dispersed over an angle $\theta$ of 110°. Pressure for spraying the solution is provided by a tank 44, which operates at a spray pressure of 2.8 kg/cm$^2$ (40 psi) and is connected to the nozzle 42 by a spray line 46. The distance between the nozzle 42 and the interior surface 18 of the panel 12 is about one-half of the panel diagonal dimension for a panel having a 3:4 aspect ratio. For example for a 51 cm (20 V) panel the distance is about 25 cm (10–12 inches). The distance would be appropriately adjusted for a panel having a 9:16 aspect ratio to provide proper coverage. A single pass of the nozzle 42 across the interior surface 18 of the viewing faceplate 17 is sufficient to provide an OC layer 32 having a thickness of about one micron. When the diluent is methyl alcohol, the drying time of the OC layer 32, at an air temperature of about 50° C. is about 30 to 45 seconds The OC layer produced by this process is continuous; however, it is believed that the only requirement is that the OC layer provides a contiguous, i.e., a substantially continuous, coating that will function as a ground electrode during the EPS process. The OC layer 32, applied by the present spray process, can be used with either the "matrix first", "matrix last" processes described above or on non-matrixed panels.

After the OC layer 32 is dry, the OPC layer 34 may be applied by conventional "spin coating" in which a quantity of an OPC solution is dispensed onto the OC layer 32 on the interior surface 18 of the panel 12, and the panel is rotated to disperse the OPC solution uniformly over th OC layer to form an OPC layer having a thickness of about 5–6$\mu$. At least a portion of the OC layer 32 along the interior surface of the sidewall 20 must extend beyond the OPC layer 34, to provide an electrical contact to the OC layer 32. Any of the OPC formulations mentioned in the cross referenced patent applications may be used to form the OPC layer 34; however, the following formulation dries rapidly, has good electrical and physical characteristics and is preferred.

The OPC solution contains the following ingredients:

300 g (10 wt. %) of Polystyrene;

50 g ( 1.66 wt. % ) of 1,4-di (2,4-methylphenyl)-1,4 diphenylbutatriene (2,4DMPBT);

2.5 g (0.083 wt. %) of 2,4,7-trinitro-9-fluorenone (TNF);

7.5 g (0.25 wt. %) of 2-ethylanthroquinone (2-EAQ);

0.15 g (0.005 wt. %) silicone U-7602; and 2648 g (balance) toluene.

The surfactant U-7602 is available from Union Carbide, Danbury, Conn. To make the OPC solution, the polystyrene resin is added to the toluene and stirred until the resin is completely dissolved. Then, the (2,4-DMPBT), an electron donor material, and the (TNF) and (2-EAQ), which are electron acceptor materials, are added to the solution and stirred. As the solution is stirred, the surfactant, silicone U-7602, is added, and the stirring is continued until all of the constituents are dissolved. The resultant solution is filtered through a series of cascade filters having openings ranging in size from 10 to 0.5$\mu$.

What is claimed is:

1. In a method of manufacturing a luminescent screen assembly for a color CRT on an interior surface of a viewing faceplate of a panel comprising the steps of:

coating said interior surface of said viewing faceplate to form a volatilizable organic conductive layer; and overcoating said organic conductive layer with an organic photoconductive solution to form a volatilizable organic photoconductive layer, the improvement wherein the step of coating said interior surface to form a volatilizable organic conductive layer includes the sub-steps of:

providing an organic conductive solution comprising a polyelectrolyte selected from the group consisting of poly(dimethyl-diallyl-ammonium chloride) and a copolymer of vinylimidazolium methosulfate and vinylpyrrolidone; and at least of polyvinyl pyrrolidone ethyl alcohol, methyl alcohol, and water; and spraying said organic conductive solution onto said interior surface of said faceplate to form said volatilizable organic conductive layer, which is substantially continuous and provides an electrode for said overlying organic photoconductive layer.

2. The method as described in claim 1, wherein, said organic conductive solution comprises:

0.5 to 2.0 wt. % of the poly(dimethyl-diallyl-ammonium chloride); about 0.3 wt. % of polyvinyl pyrrolidone, and the balance, at least one diluent selected from the group consisting of ethyl alcohol, methyl alcohol and water.

3. The method as described in claim 2, wherein said diluent comprises methyl alcohol and water.

4. The method as described in claim 3, wherein said methyl alcohol concentration ranges from 100 to 0% of said diluent.

5. The method as described in claim 1, wherein said organic solution comprises:

3 wt. % of a co-polymer of vinylimidazolium methosulfate and vinylpyrrolidone; and the balance, methyl alcohol.

6. The method as described in claim 1, wherein said spraying step includes:

locating said interior surface of said faceplate at a suitable distance from a spray apparatus;

dispensing said organic conductive solution as a substantially flat spray from a spray nozzle of said apparatus onto said interior surface; and air drying said solution at an elevated temperature.

7. The method as described in claim 6, wherein said organic conductive solution is sprayed at a pressure of about 2.8 $kg/cm^2$.

8. The method as described in claim 6, wherein said suitable distance is about one-half the diagonal dimension of said panel.

9. The method as described in claim 6, wherein said flat spray has an angular dispersion of about 110°.

10. The method as described in claim 6, wherein said drying step is at about 50° C. for about 30 to 45 seconds.

* * * * *